US005347776A

United States Patent [19]

Skoff

[11] Patent Number: 5,347,776

[45] Date of Patent: Sep. 20, 1994

[54] FLEXIBLE ROOF VENT SEALING DEVICE

[76] Inventor: James M. Skoff, 1212 Chestnut St., Oakdale, Pa. 15071

[21] Appl. No.: 43,278

[22] Filed: Apr. 6, 1993

[51] Int. Cl.[5] ..... E04D 13/08

[52] U.S. Cl. ..... 52/219; 52/199; 52/58; 285/42; 285/43

[58] Field of Search ..... 52/199, 219, 58; 285/42, 43, 44, 45

[56] References Cited

U.S. PATENT DOCUMENTS

| | | | |
|---|---|---|---|
| Re. 26,026 | 5/1966 | Dibley | 285/43 |
| 1,278,120 | 9/1918 | Donnelly . | |
| 1,287,235 | 12/1918 | Cole . | |
| 1,317,574 | 9/1919 | Grosvold . | |
| 1,464,406 | 8/1923 | Butler | 285/43 |
| 3,602,530 | 8/1971 | Elwart | 285/44 |
| 4,010,578 | 3/1977 | Logsdon | 52/58 |
| 4,115,961 | 7/1978 | Bishop | 52/199 |
| 4,120,129 | 10/1978 | Nagler et al. | 52/58 |
| 4,306,738 | 12/1981 | Lindquist | 285/42 |
| 4,563,847 | 1/1986 | Hasty | 52/219 |
| 5,010,700 | 4/1991 | Blair | 52/199 |

*Primary Examiner*—Carl D. Friedman
*Assistant Examiner*—Wynn E. Wood
*Attorney, Agent, or Firm*—Webb, Ziesenheim, Bruening, Logedon, Orkin & Hanson

[57] ABSTRACT

The present invention provides a flexible roof vent sealing system which includes a base section having a base plate and a tubular connecting member extending from the base plate and a plurality of separable sealing sections which couple to the tubular connecting member of the base section. Each sealing section includes a flexible, corrugated tubular body with a sealing portion at one end to seal against a roof vent pipe and a coupling portion at the other end of the tubular body which couples to the tubular connecting member of the base section.

19 Claims, 2 Drawing Sheets

FLEXIBLE ROOF VENT SEALING DEVICE

BACKGROUND OF THE INVENTION

1. Field of the Invention

The present invention relates to roof vent sealing devices, more particularly, to flexible roof vent sealing devices which allow for easy repair and/or replacement of the roof vent and/or the roof vent seal.

2. Description of the Prior Art

Devices for sealing roof vents have long been utilized in the art. Roof vent sealing devices have been generically referred to as roof flashing. A representative sample of the prior art can be found in U.S. Pat. Nos. 5,010,700; 4,563,847; 4,010,578; 3,602,530; 1,317,574; 1,287,235; 1,278,120 and U.S. Pat. Re. 26,026.

Several disadvantages exist with these prior art devices. One disadvantage with these prior art devices is that they often provide only limited flexibility in terms of repair or replacement. For example, once the prior art roof vents have been installed on a roof and covered with roofing tiles, shingles or similar roofing material, they fail to provide an easy manner for changing the diameter of the venting pipe should the need arise. Further, the prior art fails to provide for replacing a portion of the roof vent seal as the need may arise, for example, due to damage from sources such as falling trees, high winds, etc., or due to decay and deterioration over time. Another disadvantage of the prior art is in the installation of the roof vent pipe through the roof vent seal after the roof vent seal has been installed on a roof. In these prior art devices, the roof vent pipe sealing device must first be attached to the roof, either under the existing shingles or similar roofing materials or on a roof with no shingles or similar roofing materials and subsequently covered with shingles or similar roofing materials. Then the roof vent pipe must be pushed upwardly through the roof vent pipe sealing device and then pulled in the reverse direction to its final position to glue, solder or otherwise attach the roof vent pipe into its appropriate coupling. This final reverse downward motion causes the rubber seals of the prior art sealing devices to fold back and curve inwardly creating a water trap where leakage occurs. The seals can be straightened, but it is a difficult, time-consuming task and risks damaging the seals and affecting their integrity. Further, several of the prior art roof vent sealing devices are not compatible with flat roofs. Finally, several of the prior art devices can only accommodate roofs within a very limited range of pitches.

The present invention attempts to overcome these several disadvantages of the prior art devices.

SUMMARY OF THE INVENTION

The present invention provides a flexible roof vent sealing device which includes a base section which is adapted to be positioned on a roofing surface. The base section is positioned either underneath the existing shingles or similar roofing materials or is positioned on a roofing surface devised of shingles or other similar roofing materials and is subsequently covered by new shingles or other similar roofing materials. To explain the present invention, the term "shingles" will be used for brevity, but it is to be understood that the term "shingles" includes shingles and similar roofing materials. The base section includes a base plate and a substantially tubular connecting member extending generally perpendicularly from the base plate. A separable sealing section is coupled to the base section and includes a flexible, corrugated tubular body having a first and second end. The first end of said tubular body is coupled to said base plate. The second end of the corrugated tubular body is provided to form a watertight seal with a roof vent pipe of a given size or within a range of given sizes. A coupling portion provided at the first end of the corrugated tubular body is provided to removably attach the sealing section to the connecting member of the base section.

It is preferred that the connecting member have a threaded exterior and the coupling portion have a threaded interior which threadably engages with the threaded exterior of the connecting member. The arrangement provides a more watertight seal between the connecting member and the coupling portion and minimizes the possibility of leakage.

The present invention provides for a plurality of separable sealing sections which are adapted to be used with roof vent pipes of varying diameters.

The arrangement of the present invention provides several distinct advantages.

The upper sealing section may be easily replaced if the upper section is damaged or wears over time.

The replacement of the upper section does not require disturbing the placement of existing shingles previously installed over top of the base section. This feature becomes increasingly important over prior art roof vent seals because as the roof ages and the shingles lose resiliency and become more brittle, it is not possible to bend the shingles back and remove or replace prior art roof vent seals because the shingles will break before they will bend.

Another advantage of the present invention is that it easily facilitates the changing of the diameter of a roof vent pipe simply by changing the separable sealing section and, further, this can be done without changing the base section or disturbing the shingles.

A further advantage of the present invention is that it will avoid the problem of having a rubber seal fold in or curve inwardly on itself when the roof vent pipe is pulled back into position. With the present invention, in one embodiment, the base section is first attached to the roof and the roof vent pipe and shingles are installed next. Finally, the upper sealing section is slid downwardly over the roof vent pipe and coupled to the base section. The embodiment eliminates the need to push the vent pipe upwardly through a seal and pull it back down as is required by prior art devices, and thus prevents the sealing portion from doubling over or folding up on itself and creating undesirable leakage.

Finally, another advantage of the present invention is that it is fully compatible with roofs of any pitch, flat roofs and vertical surfaces. It is fully compatible with roofs of any pitch, because the corrugated tubular body will flex to accommodate roofs of a wide range of pitches. Further, various base plates are envisioned within the scope of the invention with varying angles between the connecting member and the base plate which will further facilitate the range of roof pitches which can be accommodated by the present invention.

A complete understanding of the invention will be obtained from the following description when taken in connection with the accompanying drawings, wherein like reference characters identify like parts throughout.

DESCRIPTION OF THE PREFERRED EMBODIMENTS

Figure 1:
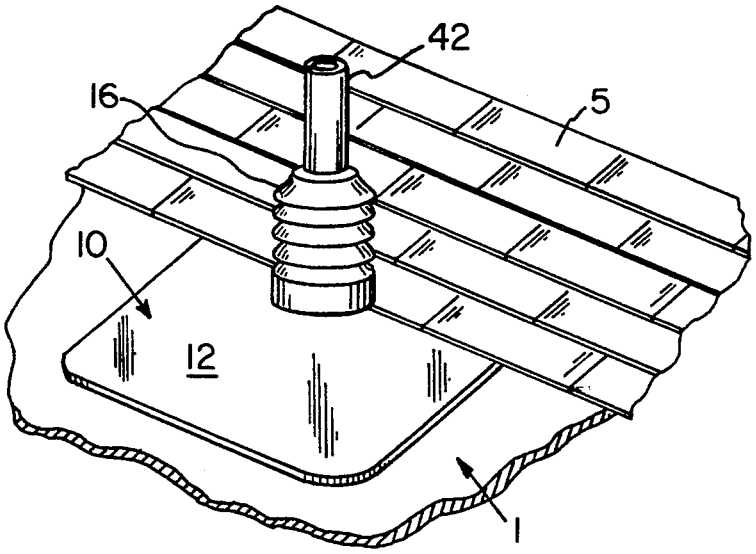
FIG. 1 illustrates a flexible roof vent sealing system according to the present invention mounted on a pitched roof.

FIG. 1 shows a flexible roof vent sealing device 1 positioned on a roofing surface underneath the shingles 5 of a roof. The roof vent sealing device 1 includes a base section 10 which is adapted to be positioned on a roofing surface underneath the shingles, and separable sealing section 16 which is adopted to be removably connected to base section 10 and to form a watertight seal around roof vent pipe 42.

Figure 2A:
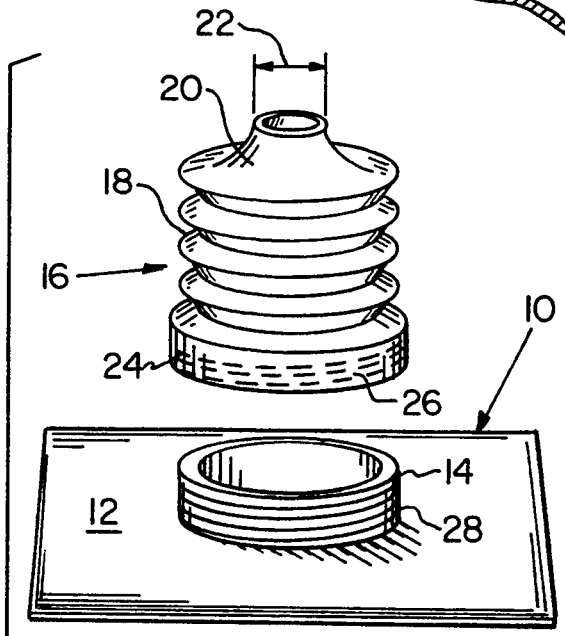
FIG. 2A is a perspective view of a flexible roof vent sealing system of the present invention showing a first separable sealing section and a base plate.
Figure 2B:
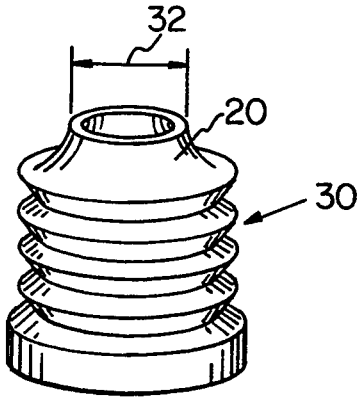
FIG. 2B is a perspective view of the flexible roof vent sealing system of FIG. 2A showing a second separable sealing section.
Figure 3:
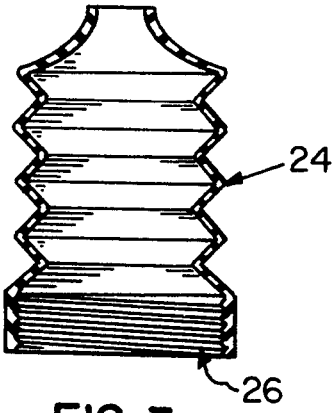
FIG. 3 illustrates a cross-sectional view of a separable sealing section of the present invention.

As shown in FIGS. 2A, 2B and 3, the base section 10 includes a base plate 12 formed of a substantially flat member. It should be understood that base plate 12 can be formed to conform to the shape of the roof, but generally would be a flat planar section. For example, if the vent were positioned at the peak or apex of a roof, the base plate 12 would have a corresponding bend so as to substantially align with the roof configuration.

A substantially tubular connecting member 14 extends generally perpendicularly from the base plate 12. The term "generally perpendicular" is purposefully selected to permit variation of the angles between the tubular member 14 and base plate 12 for roofs of greater or lesser pitch. The base section 10 will be positioned on the roof such that the connecting member 14 substantially aligns with the exit hole in the roof for the roof vent pipe. The connecting member 14 is illustrated substantially in the center of the base plate 12, but may be provided at any location thereon.

A separable sealing section 16 is removably coupled to the base section 10. The sealing section includes a flexible, corrugated tubular body 18 which can be made of rubber, metal or other suitable flexible material. A sealing portion 20 is provided at one end of the corrugated tubular body 18 and is adapted to form a watertight seal with the roof vent pipe. The sealing portion 20 has a diameter 22 sufficient to form a watertight seal with venting pipes of a given diameter or within a limited range of diameters. The sealing portion 20 will tightly seal around the venting pipe within the specified diameter or range of diameters and act substantially like an O-ring seal. Alternatively, sealing portion 20 may be designed to accept a clamping ring of metal or plastic or similar material as is known in the art.

A coupling portion 24, shown in FIGS. 2A and 3, is provided at the end of the corrugated tubular body 18 opposite sealing portion 20 on sealing section 16. As can be seen in FIGS. 2A and 3, in a preferred embodiment, the interior of the connecting portion 24 includes thread 26 which threadably engages with thread 28 on the exterior of the connecting member 14. This embodiment is preferred because connecting portion 24, having the female portion of the threadable engagement, will form a more perfect seal when threaded onto connecting member 14.

It should be noted that the threaded connection between the connecting member 14 and the coupling portion 24 is one type of secure connection between the two members. It is additionally possible with the present invention that the two members have a slip fit or other type of coupling so long as the coupling is secure and watertight.

Another sealing section 30 is illustrated in FIG. 2B and is substantially identical to the sealing section 16 described above. The diameter 32 of the sealing portion 20 of the second sealing section 30 is shown as being larger than the diameter 22 of the sealing portion 20 of the first sealing section 16. This second sealing section 30 is intended to be utilized with a pipe of a larger diameter or range of diameters than the sealing section 16. It should be appreciated that a greater number of sealing sections can be provided with varying diameters for the sealing portions so as to accommodate a wide variety of roof vent pipe diameters.

In operation, the present invention is utilized as follows. The base section 10 is positioned on a roof surface either underneath the existing shingles or is positioned on a roof before the shingles are installed and is subsequently covered with new shingles such that the tubular connecting member 14 substantially aligns with the hole in the roof for the roof vent pipe. It should be appreciated that the base section 10 can be installed either before or after the installation of the roof vent pipe. After the base section 10 is installed, and either before or after the shingles are installed, the roof vent pipe is installed and an appropriate sealing section, such as 16 or 30, is slid downwardly over the roof vent pipe and is threadably coupled to the base section 10. In an alternative but less preferred embodiment, an appropriate sealing section, such as 16 or 30, is threadably coupled to the base section 10, and the roof vent pipe is subsequently installed by inserting the roof vent pipe upwardly or downwardly through the appropriate sealing section 16 or 30 during installation of the roof vent pipe. This embodiment is less preferred because the movement of the roof vent pipe may cause sealing portion 20 of sealing sections 16 or 30 to fold back and curve inwardly creating a trap where leakage can occur, which is a disadvantage common to prior art devices.

Figure 4:
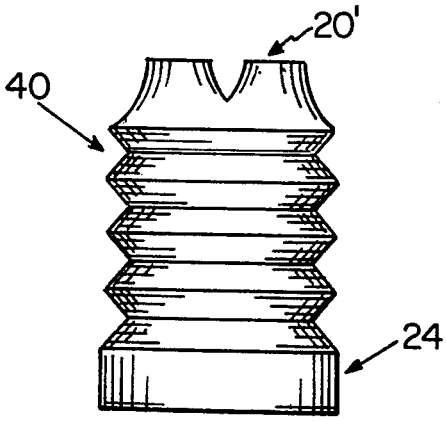
FIG. 4 is a perspective view of another separable sealing section of the present invention adapted to seal two roof vent pipes.

FIG. 4 illustrates another type of sealing section 40 according to the present invention. The sealing section 40 includes a modified sealing portion 20' which is adapted to seal around two or more adjacent roof vent pipes. For illustrative purposes, this embodiment is shown with two adjacent roof vent pipes, but it is to be understood that this embodiment can easily be modified to accept three, four or more adjacent roof vent pipes. While the need for such a system will vary with each installation, one example occurs where an existing pipe is installed and is not easily removed, such as the old cast iron, oakum jointed pipes known in the art. In such an instance, it may be desirable to simply enlarge the hole in the roof around the existing roof vent pipe or create a new hole next to the existing roof vent pipe, and insert a second roof vent pipe through the enlarged or new hole as needed, for example, for a second bathroom, etc. When utilizing the sealing section 40 shown in FIG. 4, the sealing section 40 must be either threadably coupled to the base section 10 prior to the installation of the vent pipes or, alternatively, the threadable engagement between the connecting member 14 and the coupling portion 24 is replaced with a slip fit or other type of non-threading engagement.

Figure 5:
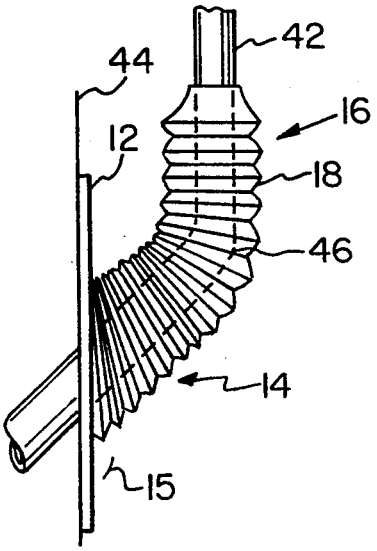
FIG. 5 is a perspective view of the flexible roof vent sealing system according to the present invention utilized with a vertical surface.

FIG. 5 illustrates the degree of flexibility of the roof vent sealing device of the present invention. While the present invention is typically used on roofs, it can even accommodate roof vent pipes exiting a structure either generally perpendicularly or at any other angle. Shown in FIG. 5, is a roof vent pipe 42 extending through a wall 44 in a structure such as a building, etc. Roof vent pipe 42 includes elbow 46 (shown in phantom). The angle 15 between base plate 12 and tubular connecting member 14 accommodates the angle with which roof vent pipe 42 exits the structure, and the corrugated tubular body 18 of sealing section 16 accommodates the elbow 46 of roof vent pipe 42.

Figure 6:
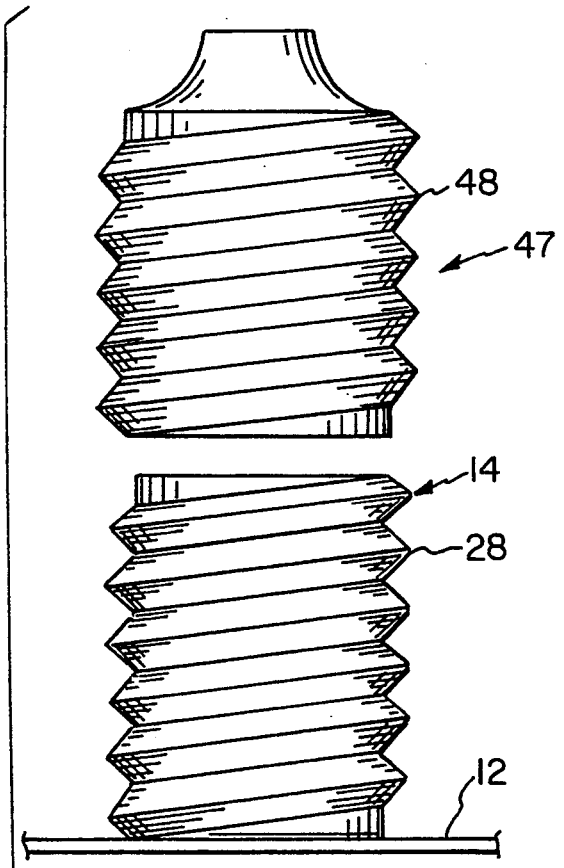
FIG. 6 is a perspective view of the flexible roof vent sealing system of the present invention showing a threadable engagement which utilizes the corrugated folds of a separable sealing section.

FIG. 6 shows the roof vent sealing device of the present invention, including base plate 12, which further includes connecting member 14 which further includes thread 28. Separable sealing section 47, shown in FIG. 6, differs from separable sealing section 16 in that it does not further include coupling portion 24 or thread 26, as is disclosed in connection with sealing section 16. Rather, the corrugations 48 of sealing section 47 are designed to threadably engage with thread 28 on the exterior of connecting member 14. The degree to which thread 28 engages with corrugation 48 will depend on the installation requirements, in that where the roof vent pipe (not shown) extends nearly perpendicularly through base plate 12, thread 28 and corrugation 48 may completely or nearly completely engage one another. However, where roof vent pipe (not shown) extends through base plate 12 at some angle other than near vertical, it is desirable to have thread 28 engage only a portion of corrugation 48 so that corrugation 48 remains flexible to accommodate various angles of the roof vent pipe.

Figure 7:
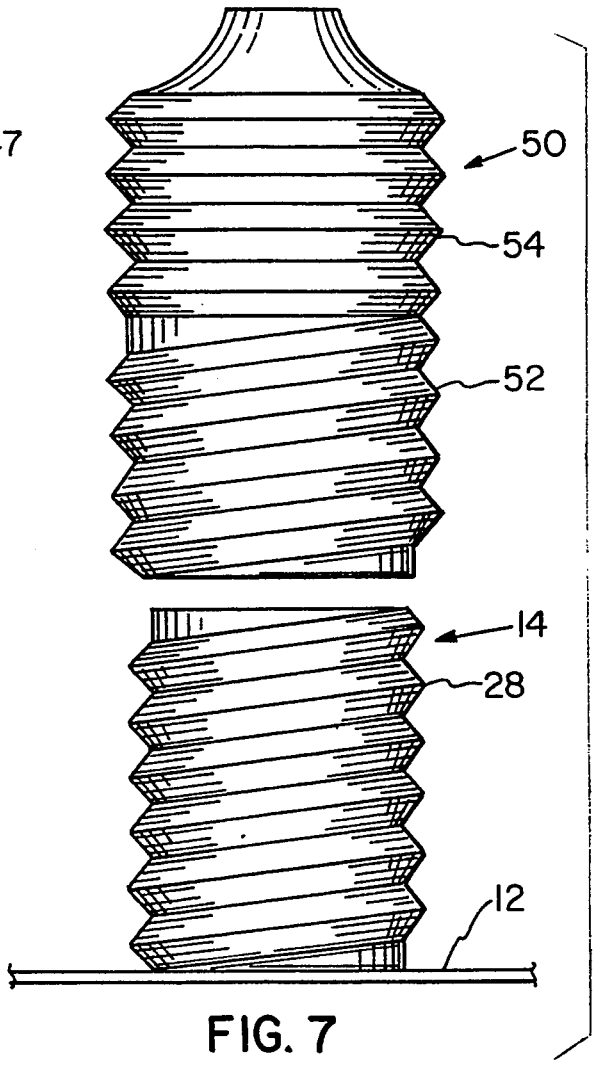
FIG. 7 is a perspective view of the flexible roof vent sealing system of the present invention showing a separable sealing section utilizing both angled and perpendicular corrugations.

In FIG. 7, an alternative embodiment of the present invention is shown which includes connecting member 14 with thread 28 on the exterior of connecting member 14. Separable sealing section 50 is shown in FIG. 7 which further includes corrugations 52 and 54. Similar to FIG. 6, corrugations 52 are designed to threadably engage with thread 28 on the exterior of connecting member 14. On the other hand, corrugations 54 are not designed to threadably engage with thread 28 on the exterior of connecting member 14, but are simply parallel to the plane of base plate 12. This embodiment of the present invention permits the corrugations 54 of sealing section 50 to remain completely flexible in all angles, as opposed to the corrugations 52 which are biased in the plane of the thread and may somewhat limit the flexibility of upper sealing section 50.

A specific embodiment of the present invention has been described in detail herein, and it will be appreciated by those skilled in the art that various modifications and alternatives to the embodiment could be developed in light of the overall teachings of the disclosure. Accordingly, the particular arrangement is illustrative only and is not limiting as to the scope of the invention which is to be given the full breadth of the appended claims and any and all equivalents thereof.

I claim:

1. A flexible roof vent sealing device comprising:

a base section adapted for attachment to a roof or wall surface including a base plate, and a substantially tubular connecting member extending from said base plate;

a separable sealing section removably coupled to said base section, said sealing section including a flexible, corrugated tubular body;

a sealing means provided at one end of said corrugated tubular body to form a watertight seal with a roof vent pipe; and a coupling means provided at the other end of said corrugated tubular body to removably attach said sealing section to said connecting member of said base section without disturbing said attachment of said base section to said roof or wall surface, said coupling means forming a watertight seal between said separable sealing section and said base section.

2. The flexible roof vent sealing device as claimed in claim 1 wherein said coupling means is threadably connectable to said connecting member.

3. The flexible roof vent sealing device as claimed in claim 2 wherein said connecting member includes a threaded exterior.

4. The flexible roof vent sealing device as claimed in claim 3 wherein said coupling means includes a threaded interior which threadably engages said threaded exterior of said connecting member.

5. The flexible roof vent sealing device as claimed in claim 3 wherein said coupling means include corrugations on said corrugated tubular body which threadably engage with said threaded exterior of said connecting member.

6. The flexible roof vent sealing device as claimed in claim 5, wherein a first portion of said corrugations threadably engage with said threaded exterior of said connecting member, and a second portion of said corrugations lie in a plane parallel with said base plate.

7. The flexible roof vent sealing device as claimed in claim 1 wherein said sealing section is provided with at least one additional sealing means to form a watertight seal with at least two roof vent pipes.

8. The flexible roof vent sealing device as claimed in claim 1 wherein said coupling means is a slip fit engagement.

9. The flexible roof vent sealing device as claimed in claim 1 further comprising a plurality of said separable sealing sections.

10. The flexible roof vent sealing device as claimed in claim 9, wherein at least one of said sealing means of said plurality of said sealing sections has a different diameter than the other said sealing means of said plurality of said sealing sections.

11. A roof vent sealing system comprising:

a base section adapted for attachment to a roof or wall surface including a base plate; and a substantially tubular connecting member extending from said base plate;

a plurality of separable sealing sections, each said separable sealing section adapted to be removably coupled to said base section, each said separable sealing section including a flexible, corrugated tubular body, wherein each of said separable sealing sections is coupled to said base section;

a sealing means provided at one end of each said corrugated tubular body to form a watertight seal with a roof vent pipe wherein each of said sealing means of said corrugated tubular body of said plurality of separable sealing sections is adapted to form said watertight seal with a roof vent pipe of a different diameter; and a coupling means provided at the other end of each said corrugated tubular body to removably attach said sealing section to said connecting member of said base section without disturbing said attachment of said base section to said roof or wall surface, said coupling means forming a watertight seal between said separable sealing section and said base section.

12. The flexible roof vent sealing system as claimed in claim 11 wherein each said coupling means is threadably connectable to said connecting member.

13. The flexible roof vent sealing system as claimed in claim 11 wherein said connecting member includes a threaded exterior.

14. The flexible roof vent sealing system as claimed in claim 13, wherein each said coupling means includes a threaded interior which threadably engages said threaded exterior of said connecting member.

15. The flexible roof vent sealing system as claimed in claim 13, wherein said each of said coupling means include corrugations on said corrugated tubular body which threadably engage with said threaded exterior of said connecting member.

16. The flexible roof vent sealing device as claimed in claim 15, wherein a first portion of said corrugations threadably engage with said threaded exterior of said connecting member, and a second portion of said corrugations lie in a plane parallel with said base plate.

17. The flexible roof vent sealing system as claimed in claim 11 wherein each of said separable sealing sections is provided with at least one additional sealing means to form a watertight seal with at least two roof vent pipes.

18. The flexible roof vent sealing system as claimed in claim 11 wherein said coupling means is a non-threading engagement.

19. The flexible roof vent sealing system as claimed in claim 11 wherein at least one of said sealing means of said plurality of sealing sections has a different diameter than the remaining sealing means of said plurality of said sealing sections.

* * * * *